United States Patent [19]

Aellen et al.

[11] Patent Number: 4,706,857

[45] Date of Patent: Nov. 17, 1987

[54] WATCH BRACELET THE ELEMENTS OF WHICH ARE MAINTAINED ASSEMBLED BY MEANS OF TWO FLEXIBLE TIES

[75] Inventors: Pierre-André Aellen, Le Landeron; Gaston Gagnebin, Bienne, both of Switzerland

[73] Assignee: Omega SA, Bienne, Switzerland

[21] Appl. No.: 742,486

[22] Filed: Jun. 7, 1985

[30] Foreign Application Priority Data

Jun. 22, 1984 [FR] France ..... 84 10016

[51] Int. Cl.[4] ..... A44C 5/00

[52] U.S. Cl. ..... 224/164; 224/172; 63/3; 368/82; D10/32; D11/2

[58] Field of Search ..... 224/164, 165, 166, 167, 224/168, 169, 170, 171, 172, 175, 178; 63/3; 368/281, 282; 24/265 WS, 265 B; D 10/31, 32, 38, 39; D 11/2, 3, 4

[56] References Cited

U.S. PATENT DOCUMENTS

| | | | |
|---|---|---|---|
| 272,829 | 2/1883 | Cockshaw | 63/3 |
| 1,676,213 | 7/1928 | Bulova | 224/172 X |
| 2,153,659 | 4/1939 | Bürk | 63/3 |
| 2,274,207 | 2/1942 | Merz | 224/172 X |
| 2,542,284 | 2/1951 | Matson | 224/175 X |
| 2,740,180 | 4/1956 | Nobles | 24/265 B X |

FOREIGN PATENT DOCUMENTS

| | | | |
|---|---|---|---|
| 618601 | 12/1926 | France | 224/172 |
| 197915 | 5/1938 | Switzerland . | |
| 318558 | 1/1957 | Switzerland . | |
| 537167 | 7/1973 | Switzerland . | |

*Primary Examiner*—Henry J. Recla
*Assistant Examiner*—David Voorhees
*Attorney, Agent, or Firm*—Griffin, Branigan, & Butler

[57] ABSTRACT

The bracelet of the invention comprises a plurality of elements articulated one after another. One of these elements supports a timepiece and the others form the links of the bracelet.

The elements are fitted into one another end-to-end and held together by means of two non-extensible flexible ties passing via channels formed in each of the elements and situated on either side of the longitudinal axis of the bracelet. The bracelet further includes at each extremity thereof a terminal piece provided with means for fixing the flexible ties.

The elements may be formed from a synthetic material reinforced with carbon fibres and the ties from a synthetic material impregnated with graphite.

9 Claims, 7 Drawing Figures

WATCH BRACELET THE ELEMENTS OF WHICH ARE MAINTAINED ASSEMBLED BY MEANS OF TWO FLEXIBLE TIES

This invention concerns a watch bracelet comprising a plurality of elements articulated one to another, at least one of the elements supporting a timepiece and the other elements forming the links of the bracelet.

BACKGROUND OF THE INVENTION

In order to assemble the different elements which make up a watch bracelet, generally there have been employed hinges which permit articulation of the elements. A large number of designs employ spring bars or more simply pins which are run through the elements.

In order to avoid this type of connection which is costly both in material and in labour, it has already been proposed in order to couple the elements to employ one or several ties which maintain assembled the links of a bracelet, each tie traversing longitudinally a plurality of consecutive links. The ties are anchored in pieces arranged on each end of the plurality of links. Swiss Pat. No. CH-A-558 639 describes such a form of execution and in particular employs ties of a non-extensible flexible plastic material partially threaded. This arrangement presents several disadvantages. Initially, to have the ties threaded and to anchor them by means of nuts buried in the links requires links of a certain thickness. Further it will be necessary to provide bore holes having at their inlet a dimension slightly greater than the diameter of the threaded tie in order that relative movement of the links be possible. Finally, it will scarcely be possible to provide an aesthetic of the bracelet integrated with the case which supports it since there is no continuity of the tie from one end to the other of the two portions of the bracelet.

There are also known watch bracelets in which there is employed an attachment cord which passes through a peripheral canal provided in the case. Swiss Pat. CH-A No. 197 915 illustrates such an arrangement where however the bracelet does not have links, giving to such realization a rigid aesthetic aspect and greatly limiting the possibilities of desirable variations.

Swiss Pat. No. CH-A 318 558 provides a watch bracelet of which the elements are connected together by at least one flexible tie and wherein each element comprises two lateral channels arranged on either side of the longitudinal axis of the bracelet and through which there passes a strand of flexible tie. However, in this arrangement there are provided sliding rings which surround the adjacent parts of the flexible tie included between the successive elements of the bracelet so that said elements are not fitted into one another, thus preventing an aesthetic form corresponding to the classical realization of a link bracelet.

Swiss Pat. No. CH-A-537 167 describes a flexible expansion bracelet composed of movable elements strung out on at least one preformed longitudinal spring. One of these elements may be hollowed out in order to receive a watch case. However, this bracelet does not provide any fitting of one link to another so that it becomes necessary to arrange a certain play between the several movable elements in order to assure sufficient flexibility to the bracelet, this leading to discontinuity in the longitudinal line of the bracelet. In order to correct even slightly such a defect, the design of the cited document shows that inwardly curving links have been employed. Finally, when the bracelet is placed around the wrist, the two tempered wires forming the spring are no longer visible as is the case in the present invention.

Finally, if one refers to Swiss Pat. No. CH-A 490 827 it will be noted that the several elements of the bracelet are fitted into one another by articulations and maintained assembly by two flexible ties. At the same time in this document it is evident that the angle of articulation of one link on to another is greatly limited, that the ties do not pass via the watch case, and moreover that they are not visible as will be apparent from the description following.

SUMMARY OF THE INVENTION

To overcome these cited disadvantages and to provide a watch bracelet at the same time easy to manufacture and having a novel and attractive aesthetic aspect, the present invention is characterized in that the watch bracelet comprises elements fitted end-to-end and held together by means of two non-extensible flexible ties passing via channels formed in each of the elements and situated on either side of the longitudinal axis of the bracelet, the outer extremities of said elements being shaped in a manner such that the ties are rendered partially visible in passing from one element to another, said bracelet further including at each end thereof a terminal piece provided with means for fixing said flexible ties.

DESCRIPTION OF THE PREFERRED EMBODIMENT

Figure 1:
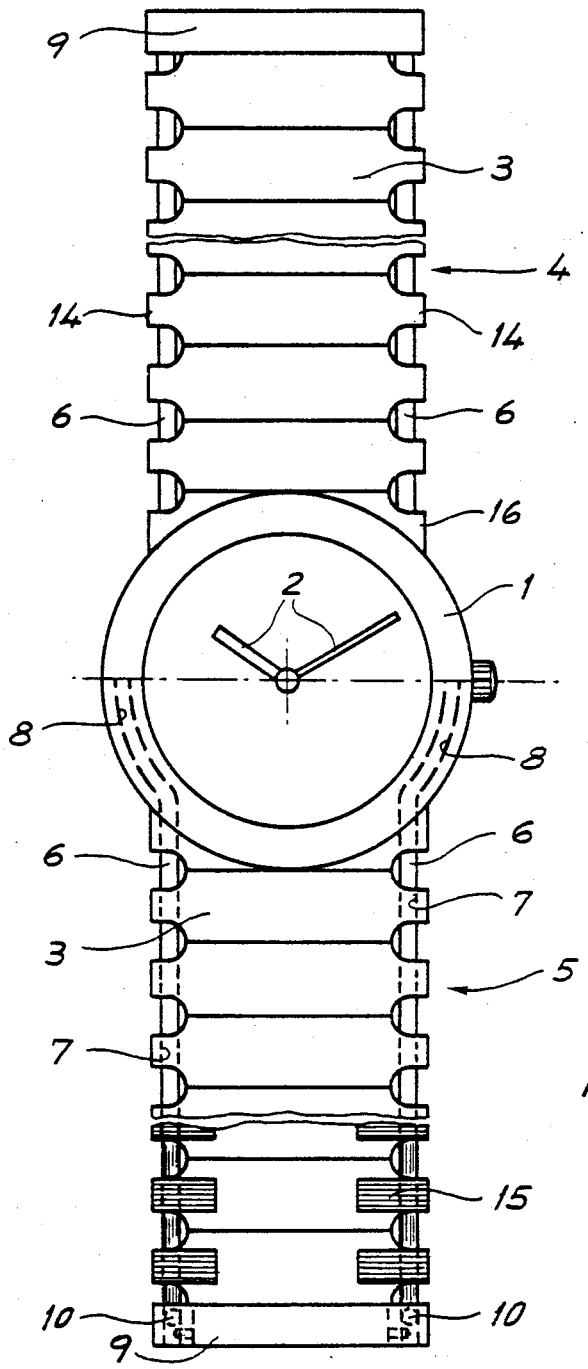
FIG. 1 is a plan view of the watch bracelet according to the invention in a first form of execution.
Figures 2, 3:
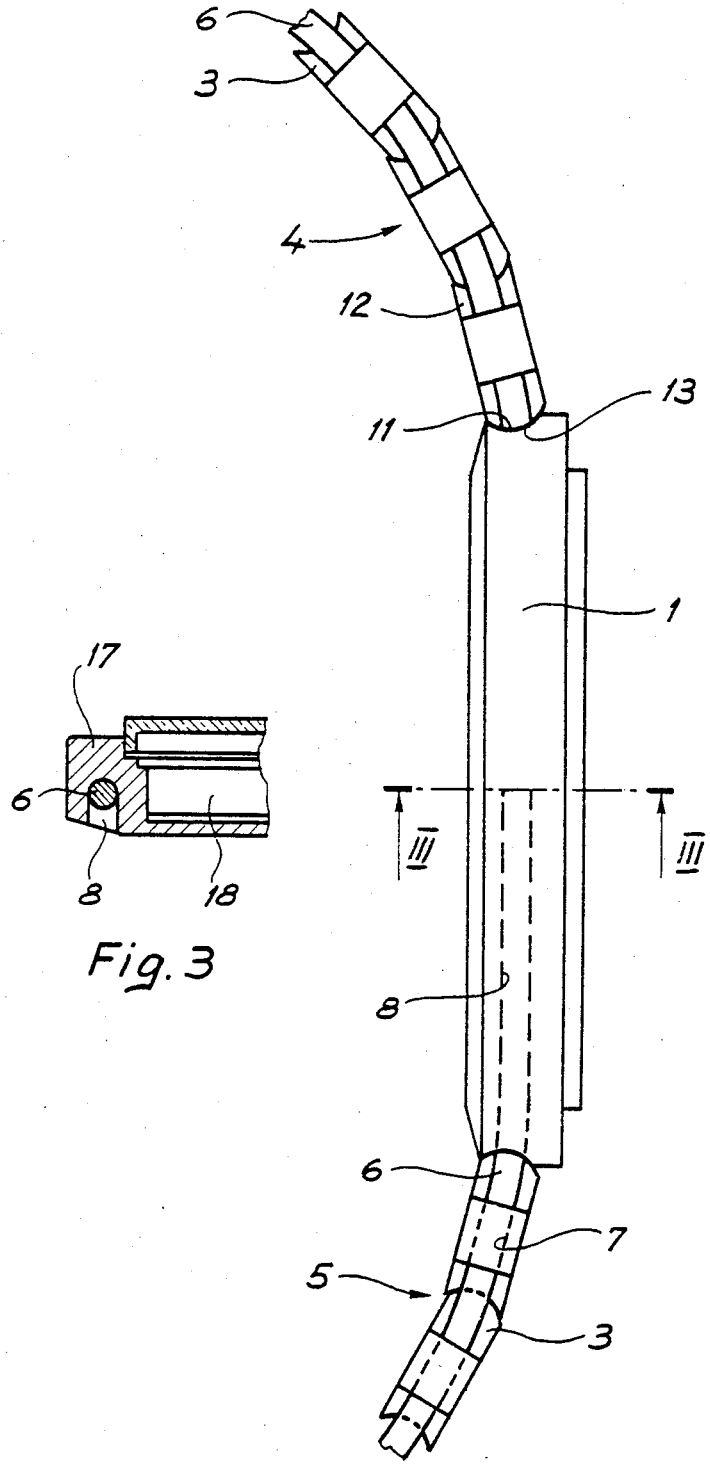
FIG. 2 is an elevational view of the watch bracelet of FIG. 1 to a larger scale.
FIG. 3 is a section taken along line III—III on FIG. 2.
Figure 5:
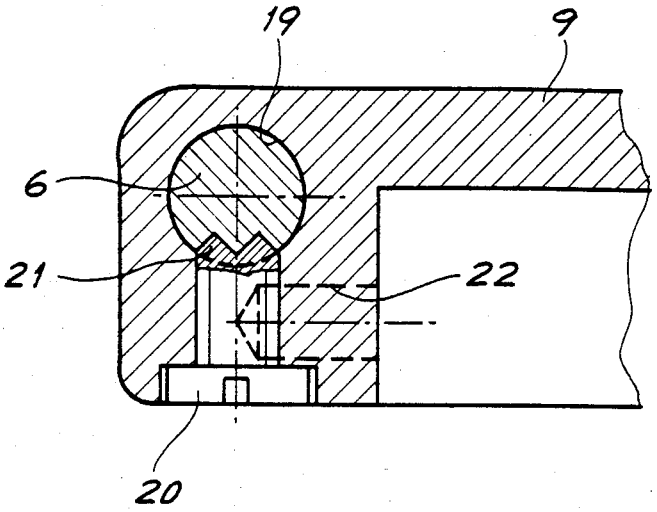
FIG. 5 is a section along line V—V of FIG. 4.
Figure 4:
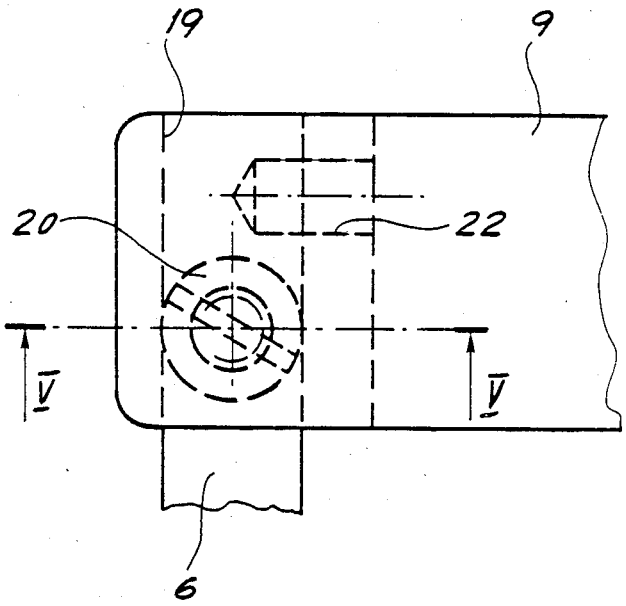
FIG. 4 is a partial view from above of one of the end pieces shown on FIG. 1.

FIGS. 1 and 2 illustrate a watch bracelet according to the invention and according to a first mode of execution. It is mainly formed of elements articulated one following another. One of these elements 1 supports a timepiece symbolized here by hands 2 displaying hours and minutes. The other elements constitute the links 3 of a bracelet in two parts 4 and 5. All the named elements are fitted one into another as may best be seen on FIG. 2. They are held assembled by means of two flexible non-extensible ties 6 which are arranged on either side of the longitudinal axis of the watch bracelet. These ties 6 pass via channels (7, 8) provided in each of the elements as may be seen in dotted outline on the two lower half portions of FIGS. 1 and 2. FIG. 1 shows further that each of the ends of the bracelet comprises a terminal piece 9 which is provided with anchoring means 10 for the ties, as will appear further on when FIGS. 4 and 5 are discussed.

As shown more particularly on FIG. 2 and in accordance with the preferred form of the invention, the elements are articulated one following another by fitting of a semicylindrical boss 11 borne for example by element 12 into a facing semi-cylindrical groove 13 borne by element 1. This arrangement enables the suppression of hinges articulated by means of bars, knuckles, and this even where the bracelets are attached to the watch case. One thereby obtains a perfect application of the elements to one another and thus a remarkable continuity of line. Such advantages will appear more particularly on the upper halves of FIGS. 1 and 2 where the channels 7 and 8 have not been shown and where the watch bracelet is shown as it really appears.

It was mentioned hereinabove that the flexible ties 6 are arranged on either side of the longitudinal axis of the bracelet. In a preferred version of the invention, the elements 3 forming the links of the bracelet are provided with necked-down portions 14 at their outer extremities. In each of these necked-down portions is provided the channel 7 in which is retained tie 6. This arrangement in addition to leaving the tie visible between two elements—which may be exploited aesthetically—allows a perfect liberty for relative movement of the links. It should also be mentioned that the necked-down portions of elements 3 may bear a decorative motif as is shown at 15 on FIG. 1.

For its part, element 1 which supports the timepiece is provided with two lateral channels 8 provided on either side of the timepiece movement. As may be seen on FIG. 1, element 1 bears at six and twelve o'clock projections 16 which form part of the watch case and are formed to resemble the links of the bracelet. In this execution channel 8 appears initially in the form of a hole provided in the projection, then in the form of an open conduit surrounding the movement. FIG. 3 shows how the tie is disposed in channel 8 which in this case is arranged in the caseband 17 bearing the timepiece 18. This arrangement enables moulding element 1 from a single piece as will appear further on.

The two flexible ties are brought out to end pieces 9 arranged at each of the ends of the bracelet. FIGS. 4 and 5 show a possible form of realization of such end piece 9 which is only partially shown. On FIG. 4 tie 6 coming from the last link, not shown, penetrates the end piece 9 (seen from above) via hole 19. Tie 6 is anchored onto piece 9 by means of screw 20. As will be best seen on FIG. 5 which is a section along line V—V of FIG. 4, screw 20 terminates in a depression 21 which notches the tie and maintains it solidly in place. End piece 9 includes means for connection to a buckle. Here the blind hole 22 is intended to receive a bar so as to attach said bar to an arm of the buckle, for instance of the type described in Swiss Pat. No. CH-A-633 698.

Although realizable in any suitable material, elements 1 and 3 will be preferably made of plastic material. If such plastic material is moreover charged with carbon fibers there will result an assembly which is both functional and aesthetic. In this case element 1 which supports the timepiece will be moulded in one piece.

For the flexible ties 6 preferably there will be also employed a plastic material. The type of material will be chosen to respond to requirements of flexibility and strength. Particularly adapted and matching perfectly from the colour viewpoint to carbon fibre, a thread of plastic impregnated with graphite, such as is known for stringing tennis rackets, responds to these requirements.

Figure 6:
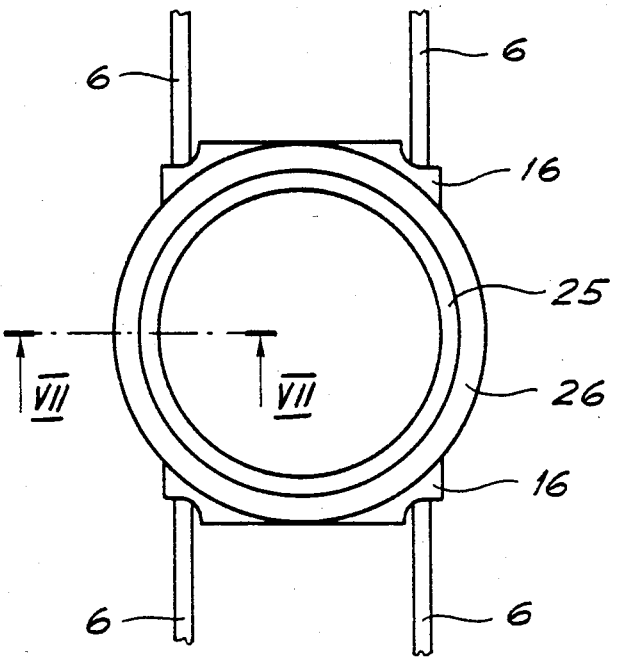
FIG. 6 is a partial plan view of the watch bracelet according to the invention according to a second form of execution.
Figure 7:
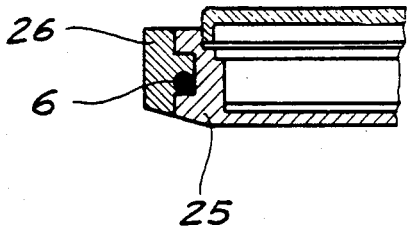
FIG. 7 is a section along line VII—VII of FIG. 6.

FIGS. 6 and 7 show a second form of the invention where there has been shown only the element of the watch bracelet bearing the timepiece. This element comprises a caseband in steel 25 the periphery of which and the surrounding flexible ties 6 are overmoulded with the plastic material 26 charged with carbon fibres. The projections 16 which form a part of this overmoulding are executed in the same manner as described hereinabove to fit with the first links of the bracelet. This realization enables greater distinguishing of the watch from the watch bracelet.

In taking advantage of what has been explained in the description hereinabove, one may obtain a watch bracelet of a new style, elegant, simple to manufacture and of low price. If moreover synthetic materials charged with carbon fibres are employed for the realization, there will be obtained an assembly of black matt colour of the most beautiful effect.

What is claimed is:

1. A watch bracelet comprising a first element including a casing for receiving a timepiece movement; first and second bracelet parts each comprising a plurality of second elements forming the links of the bracelet; first and second terminal elements; and first and second non-extensible flexible ties; said first and second elements having first and second channels extending therethrough from a first side to a second side; said first and second ties extending through all said first and second channels to interconnect said first and second elements with said first element being located between second elements in each of said first and second bracelet parts; said first and second sides of said elements having a shape at least partially interfitting with said second and first side, respectively, of the elements adjacent thereto; each of said first and second elements having regions of reduced width between said first and second sides in the regions of said first and second channels whereby said ties are visible and said bracelet may be flexed between any two adjacent ones of said elements; said terminal elements each including means for receiving and fastening one end of each of said ties.

2. A watch bracelet as set forth in claim 1 wherein said first and second elements are each articulated to the following by the fitting of a semi-cylindrical boss borne by an element into a corresponding semi-cylindrical groove borne by the adjacent element.

3. A watch bracelet as set forth in claim 1 wherein said first element is provided with two lateral channels formed on either side of said casing.

4. A watch bracelet as set forth in claim 1 wherein said second elements are provided with necked down portions at their outer extremities, a channel being formed in each of said portions adapted to accomodate one of said flexible ties.

5. A watch bracelet as set forth in claim 4 wherein each of said portions bears a decorative motif.

6. A watch bracelet a set forth in claim 1 wherein said flexible ties are fixed to the terminal pieces by means of countersunk screws.

7. A watch bracelet as set forth in claim 1 wherein said first and second elements are formed from a synthetic material reinforced with carbon fibers.

8. A watch bracelet as set forth in claim 1 wherein said flexible ties are formed from a synthetic material impregnated with graphite.

9. A watch bracelet a set forth in claim 1 wherein said first element comprises a steel caseband of which the periphery is over-moulded with synthetic material, said flexible ties being located between said caseband and said synthetic material.

* * * * *